US010376953B2

(12) United States Patent
Vida et al.

(10) Patent No.: US 10,376,953 B2
(45) Date of Patent: Aug. 13, 2019

(54) DIE-CASTING PISTON

(71) Applicant: Wieland-Werke AG, Ulm (DE)

(72) Inventors: Gabriel Vida, Metzingen (DE); Gerhard Kanzok, Burgthann (DE)

(73) Assignee: Wieland-Werke AG, Ulm (DE)

( * ) Notice: Subject to any disclaimer, the term of this patent is extended or adjusted under 35 U.S.C. 154(b) by 0 days.

(21) Appl. No.: 15/953,763

(22) Filed: Apr. 16, 2018

(65) Prior Publication Data

US 2018/0297110 A1 Oct. 18, 2018

(30) Foreign Application Priority Data

Apr. 15, 2017 (DE) ..... 10 2017 003 693

(51) Int. Cl.
*B22D 17/20* (2006.01)

(52) U.S. Cl.
CPC ..... *B22D 17/2038* (2013.01); *B22D 17/203* (2013.01)

(58) Field of Classification Search
CPC ..... B22D 17/2038; B22D 17/203; B22D 17/2015
See application file for complete search history.

(56) References Cited

U.S. PATENT DOCUMENTS 5,233,912 A * 8/1993 Mueller ..... B22D 17/203 277/451
2009/0139683 A1 6/2009 Muller et al.

FOREIGN PATENT DOCUMENTS

| | | | |
|---|---|---|---|
| DE | 19938076 | A1 | 2/2001 |
| DE | 10040578 | C1 | 10/2001 |
| DE | 10 2005 048 717 | A1 | 4/2007 |
| DE | 10 2013 017 261 | A1 | 4/2015 |
| EP | 2862647 | A1 | 4/2015 |

* cited by examiner

*Primary Examiner* — Kevin P Kerns
*Assistant Examiner* — Steven S Ha
(74) *Attorney, Agent, or Firm* — Muncy, Geissler, Olds & Lowe, P.C.

(57) ABSTRACT

A die-casting piston having a receiving unit attachable to a piston rod, which includes a cooling device and a connecting device for the piston rod. A hollow cylindrical carrier body of a cup-shaped design has a melt-side end face, on whose lateral surface at least one hollow cylindrical sliding body is mountable. An end ring is disposed between the end face of the carrier body and an end face of the sliding body, which is used as a front-end first holding element for the at least one hollow cylindrical sliding body. The carrier body is axially mountable on the receiving unit, extending over the cooling device, and may be locked to the receiving unit and released again with the aid of a connecting device, the connecting device being disposed axially downstream from the sliding body on the side facing away from the end face of the carrier body, and the connecting device being a bayonet joint.

10 Claims, 3 Drawing Sheets

DIE-CASTING PISTON

This nonprovisional application claims priority under 35 U.S.C. § 119(a) to German Patent Application No. 10 2017 003 693.4, which was filed in Germany on Apr. 15, 2017, and which is herein incorporated by reference.

BACKGROUND OF THE INVENTION

Field of the Invention

The present invention relates to a die-casting piston, comprising a receiving unit attachable to a piston rod.

Description of the Background Art

A die-casting piston having a hollow cylindrical sliding body, which is disposed on the lateral surface of a base body, is known from the publication DE 100 40 578 C1. A die-casting piston of this type is characterized in that the hollow cylindrical sliding body is spread apart, so that it is always in contact by its outer surface with the inner wall of the filling chamber surrounding it. This ensures that the sliding body of the piston rests tightly against the inner wall of the filling chamber everywhere, so that no air is able to flow into the filling chamber and thus into the die-casting chambers of a die-casting machine. To form a better seal, the sliding body is expandable radially only to a limited extent. Worn parts, in particular the sliding body, are replaced by breaking down the piston into its individual parts. For this purpose, the piston must be removed from the piston rod.

A plunger piston for cold chamber die casting machines is also known from the publication DE 199 38 076 A1, which comprises a piston head and a piston rod fixedly connected thereto. As part of the piston head, a sleeve extending up to the piston rod is designed in such a way that a cooling system having a plurality of cooling channels is formed between the sleeve and the interior of the piston head. On the front end, a planar head plate is disposed on the sleeve, which is fixed on the front end of the piston head from the front with the aid of screws. The head plate planarly abuts the front end of the sleeve, whereby the front end of the plunger piston also forms a counter-bearing for absorbing the forces during the plunging action.

A die-casting piston is also known from the publication EP 2 862 647 A1, which is incorporated herein by reference, which includes a base body attachable to a piston rod and having a melt-side end face, on whose lateral surface at least one hollow cylindrical sliding body is mountable, and a closed end ring is situated between the end face of the base body and the end face of the sliding ring. The end ring is attachable to the base body with the aid of a connecting device. The closed end ring is axially mountable on the lateral face of the base body over the end face of the base body, where it may be locked and released again with the aid of the connecting device. The closed end ring is furthermore used as a front-end first holding element for the hollow cylindrical sliding body. Due to this structural approach, wearing parts may be replaced from the front, i.e. from the piston front end. For this purpose, slide bushes, expansion rings and scraper rings are pushed over the piston head and secured with the end ring as the first holding element.

A multipart die-casting piston is also disclosed in DE 10 2005 048 717 A1 for fastening to an end area of a piston rod on the high-pressure side, which is axially displaceable in a casting cylinder of a cold chamber die-casting machine. The piston comprises a piston cover on the high-pressure side, which has a piston end wall, and a piston body in the form of a bush, which abuts the piston cover on a low-pressure side. The piston body is connected to the piston cover with the aid of fastening screws, forming a structural unit. Bayonet locking members assigned to each other on the piston cover and the end area are proposed for axially fixing the piston to the end area of the piston rod. Locking mechanisms situated in the piston cover may make it difficult to cool the piston on the front end, particularly in the location to which heat is applied the most during operation, due to their structural design having material projections.

SUMMARY OF THE INVENTION

It is therefore an object of the present invention to provide a die-casting piston with regard to maintenance friendliness and functionality.

In an exemplary embodiment, the invention provides a die-casting piston having a receiving unit attachable to a piston rod, which includes a cooling device and a connecting device for the piston rod. A hollow cylindrical carrier body of a cup-shaped design is also provided having a melt-side end face, on whose lateral surface at least one hollow cylindrical sliding body is mountable. A closed end ring is also provided that is disposed between the end face of the carrier body and an end face of the sliding body, which is used as a front-end first holding element for the at least one hollow cylindrical sliding body.

The carrier body can be axially mountable on the receiving unit, extending over the cooling device, and may be locked to the receiving unit and released again with the aid of a connecting device, the connecting device being disposed axially downstream from the sliding body on the side facing away from the end face of the carrier body, and the connecting body being a bayonet joint. Die-casting pistons of this type are suitable for use in vacuum die-casting machines as well as for other designs.

The bayonet joint may have different designs. For example, it may include suitable metallic tabs on the carrier body and on the receiving unit, which are each designed in such a way that they are able to engage with corresponding recesses of the particular connecting partner. The carrier body and the receiving unit can be connected as connecting partners, for example, by being inserted into each other and rotated in opposite directions, and they may also be separated in this way. Consequently, connection is via an insertion-and-rotation motion.

In an embodiment, the wearing parts are disposed on the hollow cylindrical carrier body, which is removable from the receiving device as a module. For mounting purposes, a hollow cylindrical sliding body or multiple sliding bodies in the form of slide bushes and/or expansion rings, and possibly the scraping element in the form of one or multiple scraper rings, are pushed onto the lateral surface of the carrier body and secured with an end ring which closes on the front side. These may be removed again and replaced in the opposite order.

An actuating mechanism for fixing and releasing the connection between the carrier body and receiving unit can be carried out in the bayonet joint by an insertion-and-rotation motion. A form fit is formed in this way in the axial direction in the locked position of the bayonet joint. The entire construction for retaining purposes is aimed at preventing the effect of the cooling device from being impaired. Consequently, the connecting device is designed according to the available installation space, depending on the piston size. Assemblies on the carrier body and on the receiving element, which are complementary to each other, are advantageously positioned and constructed in such a way that they interact to form a closing mechanism of a bayonet joint.

Form-fitting connections of this type are produced by the engagement of both connecting partners.

The end ring usually does not or only slightly overlaps the end face of the carrier body. Only the end face of the carrier body is significantly exposed in a desirable manner to the temperature of the melt. The piston cooling may efficiently take effect here by a suitable section of material.

The carrier body may be manufactured from steel or from copper or a copper alloy. A carrier body made from copper offers advantages with regard to the cycle times of the die-casting machine, in particular during aluminum die casting, due to its better heat conductivity. Carrier bodies made from steel, on the other hand, have the advantage that they are more robust, i.e. have longer service lives. The sliding body may also be manufactured from steel.

In particular, the absorption of the axial force applied to the die-casting piston may present difficulties during the operation of the die-casting machine, or this may be satisfactorily achieved only with a great deal of structural complexity. The hollow cylindrical carrier body according to the invention, however, forms a one-piece, cup-shaped hollow body with the melt-side end face, which, as a compact assembly, is also designed for a tensile or pressure load. As a result, it may also absorb the axial forces of the piston rod via the receiving unit during the operation of the die-casting piston.

A particular advantage is that wearing parts may be replaced from the front end of the piston with the aid of a modular design. For this purpose, slide bushes, expansion rings and scraper rings are pushed over the carrier body and secured with the end ring in the direction of the front side. The entire module may then be fixed on the receiving unit with the aid of the bayonet joint. Connecting devices of this type are particularly stable and reliable, due to their form fit in the axial direction when operating a die-casting machine under tensile or pressure load. Under operating load, compressive or tensile forces take effect normally, i.e. perpendicularly to the surfaces of the two connecting partners. Another advantage is that the front-end cooling of the piston is successful on the end face of the carrier body in the location where heat is applied the most during operation. Here the cooling device may be designed for an effective heat removal of the heat introduced by the metal melt via the piston front end. In the front area, the cup-shaped carrier body is preferably designed with a uniform wall thickness, at least on the front end.

In an embodiment of the invention, the carrier body can be rotatably fixedly lockable with respect to the receiving unit with the aid of at least one fixing element. In principle, any component which prevents an unintentional separation of the connecting device can be suitable as the fixing element. The fixing element primarily prevents the unintentional counter-rotational movement for opening the bayonet joint. For example, radially insertable screw connections or spring-loaded clamping pins may be used as the fixing element, which are disposed in the carrier body and extend up to the receiving unit.

The at least one fixing element may be advantageously accessible on the outer circumference of the piston for locking purposes. A special construction principle is used for this purpose, which makes it possible to establish a locking operative connection of the carrier body over the outer circumference of the piston, for example from easily accessibly points on the die-casting piston. Connecting devices of this type represent, for example, independent fixing systems having multiple individual parts. A connecting device of this type is, of course, detachable and suitable for releasing the carrier body again to the extent that the bayonet joint, for example, may be detached. Radially engaging locking mechanisms, for example, which are accessible from the cylindrical surface of the piston, are particularly suitable for this purpose.

It is also advantageous that the at least one hollow cylindrical sliding body is fixable on the side facing away from the end face of the carrier body by a mounting ring as the second holding element. The mounting ring is used as the second holding element having a rear stop or flange, which is planarly abutted by a front end of the adjacent rings. In its radial extension, the mounting ring is equal to or smaller than the other sliding bushes, expansion rings or scraper rings. In any case, the mounting ring does not project over the circumference thereof. If necessary, the mounting ring may also advantageously produce an axially acting pretension on the hollow cylindrical sliding body. Due to a pretension, the sliding bodies, expansion rings or scraper rings have no clearance in the axial direction and are pressed against each other on the front end. The undesirable penetration of residual melt between the particular end faces is effectively prevented hereby during operation.

In an embodiment of the invention, the mounting ring may have a rotatably fixed design with respect to the carrier body. For this purpose, the inner contour of the mounting ring may have a shape deviating from the circular, which matches a design, complementary therewith, on the outside of the carrier body. In other words, the mounting ring is rotatably fixedly positioned on the carrier body from the back after mounting the sliding bodies and possibly the expansion rings or scraper rings. The mounting ring may thus be used to handle the assembled carrier body using a suitable tool or to close the bayonet joint by means of an insertion-and-rotation motion or to open it by means of a rotation-and-pulling motion.

At the position of the mounting ring, the outer contour of the carrier body may be designed as a polygon, and the inner contour of the mounting ring may also be designed as a polygon which forms a precise fit with the outer contour of the carrier body. The flat surfaces of the polygon effectuate a reliable, rotatably fixed arrangement of the mounting ring. The mounting ring should be able to be easily removed hereby from the carrier body in the axial direction. Even after the carrier body is removed, the polygon remaining on the outer contour of the carrier body may itself be a contact surface for suitable tools for retaining, cleaning, reworking or storage purposes.

In an embodiment of the invention, the mounting ring can also be lockable using the at least one fixing element. Radially insertable screw connections or spring-loaded clamping pins may be used as the fixing element, which are disposed in the mounting ring and extend through the carrier body up to the receiving unit. In this way, a fixing element for the mounting ring may simultaneously also be used to prevent the rotation of the bayonet joint. The bayonet joint is then preferably situated radially within the mounting ring in the same mounting plane downstream from the sliding body. This mounting area is effectively situated behind the parts of a die-casting piston subjected to the most thermal load downstream from the cooling device.

At the position of the mounting ring, the outer contour of the receiving unit may have a maximum radial extension as the polygon, which is smaller than the inner diameter of the at least one hollow cylindrical sliding body. This makes it possible to readily dispose sliding bodies and possibly expansion rings or scraper rings on the carrier body from the rear.

In an embodiment of the invention, the outer contour of the mounting ring may be designed as a polygon. Contact surfaces for mounting tools are created hereby, which may be used to position or remove the carrier body on/from the receiving unit.

In an embodiment, the fixing element may be disposed on the outer contour of the mounting ring on a surface of the polygon. The surfaces of the polygon are situated radially internally and are level with respect to the hollow cylindrical sliding body. These surfaces are therefore particularly suitable for disposing screw or plug connections thereon as fixing elements.

In principle, the die-casting piston may be structurally designed on the front as disclosed in DE 10 2013 017 261 A1 of the applicant, which is incorporated herein by reference, in such a way that the closed end ring is mountable on the lateral surface of the base body, axially over the end face of the base body in the function of a carrier body, and it back be locked thereon and released again with the aid of the connecting device.

In an embodiment of the invention, the end ring may be supported against a front-end stop formed on the carrier body to prevent axial displacement. The end ring is fixed axially to the front thereby on the carrier body.

The end stop may advantageously be a circumferentially running projection from the lateral surface of the carrier body. The projection is created in such a way that the axial forces of the additional sliding bodies or scraping rings, which occur during operation, may always be absorbed.

In an embodiment of the invention, at least the end ring and the directly adjacent, hollow cylindrical sliding body may have complementary shoulders at the particular front-end joints, whereby they mesh in an overlapping manner. For example, the rings mesh with each other at their joints in the axial direction after mounting. Due to a corresponding design of the shoulders, a mutual anti-rotation of the rings may also be established.

The end ring may be made from a harder material than the sliding body. In this way, it is possible to manufacture the end ring from steel, for example, and the sliding body from a softer, more slidable material, such as copper or a copper alloy. The end face of the piston, which is subjected to extreme stress, is thus also formed from a hard material in the radially outer area, whereby the more sensitive sliding body is protected by the ring. The danger of scoring and piston jamming is thus averted. The service life of both the piston and the filling chamber may be significantly increased thereby.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
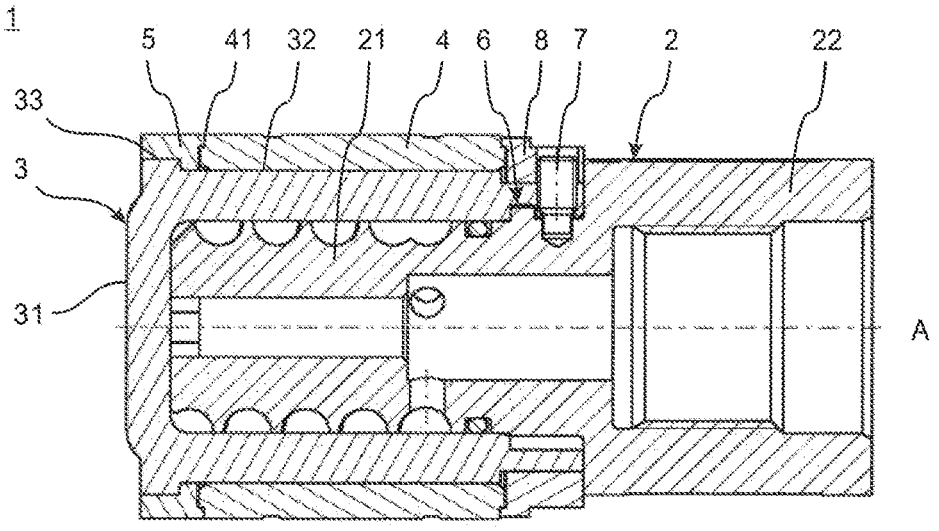
FIG. 1 shows a schematic representation of an axial longitudinal section of a die-casting piston according to an embodiment of the invention.

FIG. 1 shows a schematic representation of an axial longitudinal section along piston axis A of a die-casting piston 1 according to the invention. Die-casting piston 1 having direct cooling includes a carrier body 3, which also forms the melt-side end face 31 of die-casting piston 1. A slide bush is disposed on carrier body 3 as a hollow cylindrical sliding body 4. A preferably closed end ring 5 as a first holding element, which is preferably made from a harder material than sliding body 4, is disposed on lateral surface 32 of carrier body 3 between end face 31 of carrier body 3 and front-end face 41 of sliding body 4. Sliding body 4 is protected in this manner against direct contact with the hot casting material.

In FIG. 1, carrier body 3 is mounted on receiving unit 2, extending over cooling device 21, and locked to receiving unit 2 with the aid of a bayonet joint 6 as the connecting device. Carrier body 3 and receiving unit 2 are consequently connected to each other as connecting partners by an insertion-and-rotation motion. In this specific embodiment, receiving unit 2 has suitable metallic tabs for this purpose. Receiving unit 2 is designed in such a way that the metallic tabs are able to engage with corresponding recesses of carrier body 3. Connecting device 22 for the piston rod is located on the back of receiving unit 2 facing away from carrier body 3.

The connection of carrier body 3 is rotatably fixedly locked with respect to receiving unit 2 by a screw-like or pin-like fixing element 7, whereby the unintentional opening of the bayonet joint is prevented. Fixing element 7 is preferably disposed on the outer circumference of the piston and is thus located at an easily accessible point on die-casting piston 1. Radially engaging locking mechanisms, which are accessible from the cylindrical surface of die-casting piston 1, are particularly suitable.

Mounting ring 8 is used as a second holding element having a back-side stop, which is planarly abutted by the reversing front end of hollow cylindrical sliding body 4. The radial extension of mounting ring 8 is preferably slightly smaller than the radial extension of sliding body 4.

A front-end stop 33 is used to retain preferably closed end ring 5, whereby end ring 5 is supported against axial displacement toward the front. Front-end stop 33 is a circumferentially running projection from lateral surface 32 of carrier body 3. The projection is created in such a way that the axial forces occurring during operation may be absorbed. End ring 5 and directly adjacent, hollow cylindrical sliding body 4 have complementary shoulders at particular front-end joints 41, whereby they mesh in an overlapping manner.

Figure 2:
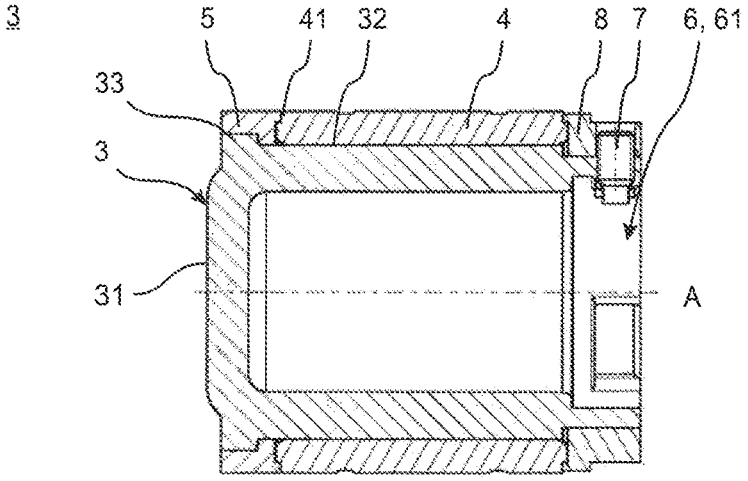
FIG. 2 shows a schematic representation of an axial longitudinal section of a modularly constructed carrier body.

FIG. 2 shows a schematic representation of an axial longitudinal section of a modularly constructed carrier body 3. The wearing parts that are stressed the most by temperature or by friction are disposed on hollow cylindrical carrier body 3, which is easily removable as a module from the receiving unit. Hollow cylindrical sliding body 4 is pushed onto lateral surface 32 of carrier body 3 and secured by an end ring 5 closing on the front. End ring 5 itself is fixed by a front-end stop 33 formed in carrier body 3, which prevents an axial displacement over end face 31 of carrier body 3. These parts may be removed again and replaced in the opposite order. With the aid of bayonet joint part 61, and possibly with the aid of tools set on mounting ring 8, the entire module may then be connected to the receiving unit using bayonet joint part 62 located thereon. Fixing element 7 prevents the unintentional counter-rotation movement for opening the bayonet joint.

Figure 3:
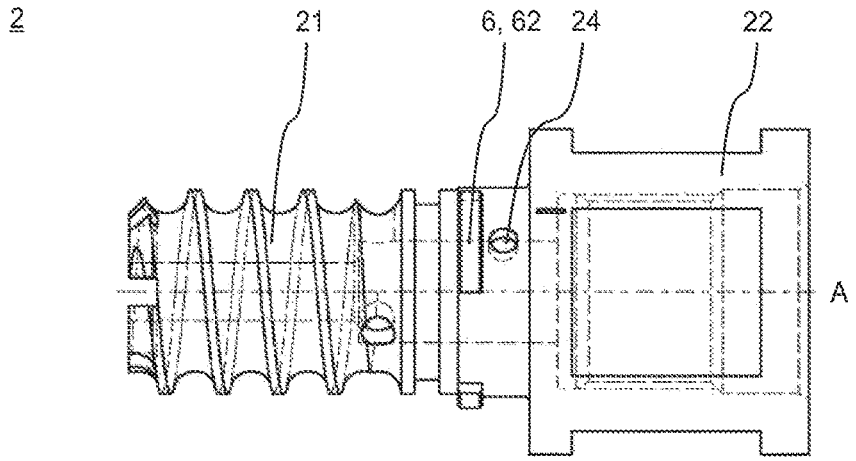
FIG. 3 shows a schematic view of a receiving unit.

FIG. 3 shows a schematic view of a receiving unit 2. The part facing the front end of the piston forms cooling device 21 in connection with the inner wall of the carrier body. Connecting device 22 for the piston rod is located on the back of receiving unit 2 facing away from carrier body 3. Bayonet joint part 62 of receiving unit 2 is located between cooling device 21 and connecting device 22. In this embodiment, receiving unit 2 has metallic tabs for this purpose, which may engage with corresponding recesses of the carrier body for connecting purposes. Recess 24 is a bore, with which a fixing element engages in the mounted state.

Figure 4:
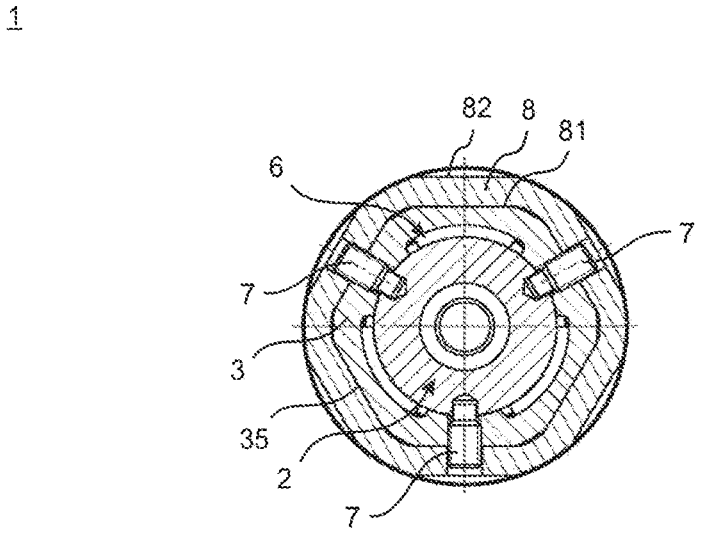
FIG. 4 shows a schematic representation of a cross section of a die-casting piston according to an embodiment of the invention in the plane of the bayonet joint.

FIG. 4 shows a schematic representation of a cross section of a die-casting piston 1 according to the invention in the plane of bayonet joint 6. Receiving unit 2 is situated internally in this sectional plane. Hollow cylindrical carrier body 3 encompasses receiving unit 2 with the aid of mounting ring 8, forming bayonet joint 6. Within mounting ring 8, the outer contour of carrier body 3 is designed as a polygon 35, and the inner contour of mounting ring 8 is also designed as a polygon 81, which forms a precise fit with the outer contour of carrier body 3. This necessitates the desired anti-rotation protection of both parts with respect to each other. The outer contour of mounting ring 8 is also designed as a polygon 82 as a mounting aid and for setting suitable mounting tools. Mounting ring 8 and carrier body 3 are locked to receiving unit 2 and secured with the aid of the three fixing elements 7 illustrated in FIG. 4.

Figure 5:
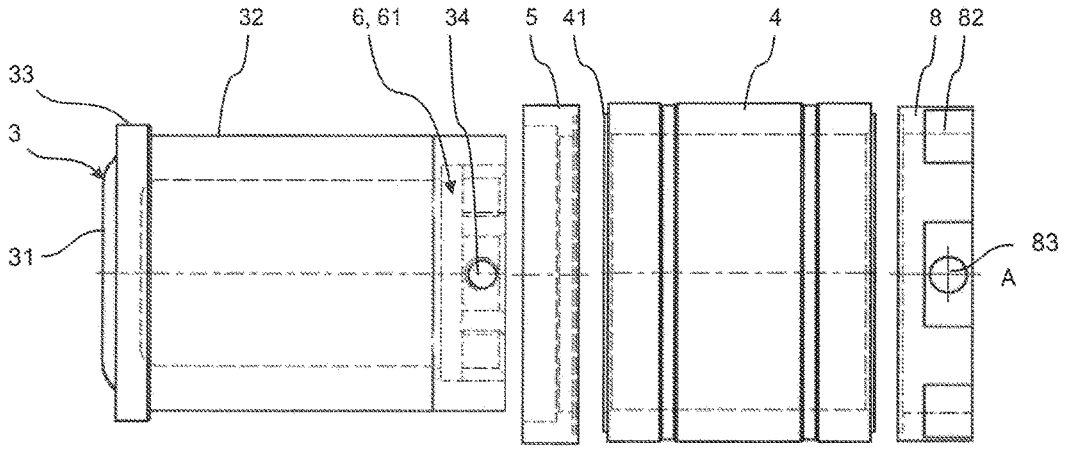
FIG. 5 shows an exploded drawing of a modularly constructed carrier body.

FIG. 5 shows an exploded drawing of a modularly constructed carrier body 3, including the additional components. In the order illustrated, end ring 5, hollow cylindrical sliding body 4 and mounting ring 8 are pushed onto carrier body 3 before this module unit is connected to the receiving unit, forming the bayonet joint.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A die-casting piston comprising:

a receiving unit attachable to a piston rod, the receiving unit having a cooling device and a first connecting device for the piston rod;

a hollow cylindrical carrier body having a cup-shaped design, the hollow cylindrical carrier body including a melt-side end face and a lateral surface, at least one hollow cylindrical sliding body being mounted on the lateral surface; and an end ring being arranged between the melt-side end face of the carrier body and an end face of the at least one hollow cylindrical sliding body, the end ring being a front-end first holding element for the at least one hollow cylindrical sliding body, wherein the carrier body is axially mountable on the receiving unit extending over the cooling device and is adapted to be locked to the receiving unit and released again via a second connecting device, wherein the second connecting device is arranged axially downstream from the at least one hollow cylindrical sliding body on a side facing away from the melt-side end face of the carrier body, wherein the second connecting device is a bayonet joint, wherein the at least one hollow cylindrical sliding body is fixable on a side facing away from the melt-side end face of the carrier body by a mounting ring, and wherein the mounting ring is designed to be rotatably fixed with respect to the carrier body.

2. The die-casting piston according to claim 1, wherein the carrier body is rotatably fixedly lockable with respect to the receiving unit with the aid of at least one fixing element, and wherein the at least one fixing element is accessible on an outer circumference of the piston for locking purposes.

3. The die-casting piston according to claim 1, wherein at a position of the mounting ring, an outer contour of the carrier body is designed as a polygon, and wherein an inner contour of the mounting ring is designed as a polygon that corresponds with the outer contour of the carrier body.

4. The die-casting piston according to claim 1, wherein the end ring is supported against a front-end stop formed on the carrier body to prevent axial displacement.

5. The die-casting piston according to claim 4, wherein the front-end stop is a circumferentially running projection from the lateral surface of the carrier body.

6. The die-casting piston according to claim 1, wherein at least the end ring and the at least one hollow cylindrical sliding body, that is directly adjacent thereto, have complementary shoulders that mesh in an overlapping manner, the complementary shoulders being front end joints.

7. The die-casting piston according to claim 1, wherein the end ring is made from a harder material than the at least one hollow cylindrical sliding body.

8. A die-casting piston comprising:

a receiving unit attachable to a piston rod, the receiving unit having a cooling device and a first connecting device for the piston rod;

a hollow cylindrical carrier body having a cup-shaped design, the hollow cylindrical carrier body including a melt-side end face and a lateral surface, at least one hollow cylindrical sliding body being mounted on the lateral surface; and an end ring being arranged between the melt-side end face of the carrier body and an end face of the at least one hollow cylindrical sliding body, the end ring being a front-end first holding element for the at least one hollow cylindrical sliding body, wherein the carrier body is axially mountable on the receiving unit extending over the cooling device and is adapted to be locked to the receiving unit and released again via a second connecting device, wherein the second connecting device is arranged axially downstream from the at least one hollow cylindrical sliding body on a side facing away from the melt-side end face of the carrier body, wherein the second connecting device is a bayonet joint, wherein the at least one hollow cylindrical sliding body is fixable on a side facing away from the melt-side end face of the carrier body by a mounting ring, and wherein, at a position of the mounting ring, an outer contour of the receiving unit has a maximum radial extension as a polygon, which is smaller than an inner diameter of the at least one hollow cylindrical sliding body.

9. A die-casting piston comprising:

a receiving unit attachable to a piston rod, the receiving unit having a cooling device and a first connecting device for the piston rod;

a hollow cylindrical carrier body having a cup-shaped design, the hollow cylindrical carrier body including a melt-side end face and a lateral surface, at least one hollow cylindrical sliding body being mounted on the lateral surface; and an end ring being arranged between the melt-side end face of the carrier body and an end face of the at least one hollow cylindrical sliding body, the end ring being a front-end first holding element for the at least one hollow cylindrical sliding body, wherein the carrier body is axially mountable on the receiving unit extending over the cooling device and is adapted to be locked to the receiving unit and released again via a second connecting device, wherein the second connecting device is arranged axially downstream from the at least one hollow cylindrical sliding body on a side facing away from the melt-side end face of the carrier body, wherein the second connecting device is a bayonet joint, wherein the at least one hollow cylindrical sliding body is fixable on a side facing away from the melt-side end face of the carrier body by a mounting ring, and wherein an outer contour of the mounting ring is designed as a polygon.

10. The die-casting piston according to claim 9, wherein the at least one fixing element is arranged on the outer contour of the mounting ring on a surface of the polygon.

* * * * *